United States Patent [19]

Kawai et al.

[11] 4,121,929

[45] Oct. 24, 1978

[54] NITROGEN CONTAINING HIGH SPEED STEEL OBTAINED BY POWDER METALLURGICAL PROCESS

[75] Inventors: Nobuyasu Kawai; Katuhiko Honma, both of Kobe; Hirofumi Fujimoto, Ono; Hiroshi Takigawa, Kobe; Minoru Hirano, Kobe; Masaru Ishii, Kobe, all of Japan

[73] Assignee: Kobe Steel, Ltd., Kobe, Japan

[21] Appl. No.: 767,900

[22] Filed: Feb. 11, 1977

[30] Foreign Application Priority Data

Feb. 12, 1976 [JP] Japan ..... 51-14440

[51] Int. Cl.[2] ..... B22F 3/00

[52] U.S. Cl. ..... 75/238; 75/243; 75/244; 75/123 B; 75/123 J; 75/126 R; 75/126 J

[58] Field of Search ..... 75/244, 238, 243, 123 B, 75/123 J, 126 R, 126 J

[56] References Cited

U.S. PATENT DOCUMENTS

| | | | |
|---|---|---|---|
| 3,650,729 | 3/1972 | Kindlimann et al. | 75/244 |
| 3,696,486 | 10/1972 | Benjamin | 75/244 |
| 3,778,235 | 12/1973 | Kindlimann et al. | 75/244 |
| 3,836,406 | 9/1974 | Yoda | 75/126 J |

*Primary Examiner*—Brooks H. Hunt

*Attorney, Agent, or Firm*—Oblon, Fisher, Spivak, McClelland & Maier

[57] ABSTRACT

A nitrogen containing high speed steel produced by powder metallurgical process, which comprises at least 0.40% N, 3.0–15% V, C in an amount satisfying the relationship of $1.0 + 0.2V\ (\%) \leqq (C + N) \leqq 1.5 + 0.2V\ (\%)$, at least one element selected from the group consisting of up to 15% Cr, up to 10% Mo, up to 20% W, and up to 15% Co, with balance iron.

7 Claims, 8 Drawing Figures

NITROGEN CONTAINING HIGH SPEED STEEL OBTAINED BY POWDER METALLURGICAL PROCESS

BACKGROUND OF THE INVENTION

The present invention relates to a high speed steel produced by powder metallurgical process, more particularly to a nitrogen containing high speed steel produced by powder metallurgical process, wherein the amounts of C, N and V are properly adjusted to improve continuous cutting property.

DESCRIPTION OF PRIOR ART

It is known that property of high speed steels containing alloying elements such as Cr, W and V can be improved by incorporation of nitrogen into the steels (see, for example, Kobe Steel Technical Bulletin, R & D, Vol. 24, No. 3, pages 11 to 15, and Japanese Patent Application Laid-Open Specifications No. 78606/74, No. 49109/75 and No. 49156/75). By nitriding treatment, a nitride or carbonitride of the type MX or $M_6X$ (in which M stands for an alloying element and X stands for carbon or nitrogen) is formed, and this nitride or carbonitride is more stable than a carbide of the type MC or $M_6C$. Accordingly, the appropriate quenching temperature range is broadened and control of the heat treatment can be facilitated.

Further, the temper hardening characteristic is improved and a fine austenitic crystal structure can be obtained to improve the mechanical properties. Furthermore, the machinability of the steels can be improved. It is construed that by virtue of these effects, the properties of such high speed steels can be improved by incorporation of nitrogen into the steels.

Most conventional nitrogen containing high speed steels have heretofore been prepared by smelting process. When the smelting process is adopted for production of nitrogen containing high speed steels, it is necessary to perform complicated steps such as the step of melting steel in a high pressure nitrogen atmosphere or the step of throwing a nitride into molten steel. Further, according to the smelting process, since the amount of nitrogen included in the steel is small and it is difficult to form a fine carbonitride and distribute it uniformly in steel, it is impossible to improve the properties to desirable levels.

As a means of overcoming the defects or limitations involved in the smelting process, methods have recently been proposed for obtaining nitrogen containing high speed steels by the powder metallurgical process or the powder forging process. In these methods, by utilizing the fact that powder has a large specific surface area (surface area/volume) and the fact that a powder sintered body has a porous structure, an optional amount of nitrogen can be included in steel by a simple means, for example, by adding nitrogen in advance to the starting powder or adjusting the heating temperature, the heating time or the nitrogen partial pressure in the treatment atmosphere at the sintering step. It is expected that nitrogen will be finely and uniformly distributed in steels according to these methods.

In conventional nitrogen containing high speed steels produced by powder metallurgical process, the machinability is not as highly improved as might be expected. Rather the machinability is degraded by incorporation of nitrogen into the steels. Accordingly, it is often said that the value of nitrogen containing high speed steels produced by powder metallurgical process is questionable. However, several nitrogen containing high speed steels produced by powder metallurgical process, which have recently been put into practical use, have exhibited good machinability and good wear resistance in combination. The reason for this has not been elucidated. In particular, the relation between amounts of alloying elements which impart excellent machinability to steel and the amount of nitrogen enrichment is not clarified. Therefore, the kinds of steels which are enriched with nitrogen for the production of high speed steels by powder metallurgical process and which are applicable are drastically limited. For example, Kobe Steel Technical Bulletin, R & D, Vol. 24, No. 3, page 10 discloses that when 0.5–0.5% nitrogen is added to Mo type high speed steels (JIS SKH 9 and modified JIS SKH 55) by powder metallurgical process, the machinability of intermittent cutting tools such as pinion cutter and hob, is remarkably improved.

However, cutting test results wherein a continuous cutting tool such as drill or bit (single point tool) of nitrogen containing high speed steel produced by powder metallurgical process is adopted as a cutter are rarely reported. The machinability of a continuous cutting tool closely relates to wear resistance and heat resistance of the tool. It is generally known that increase in amounts of carbide forming elements such as V, W and Mo is advantageous to improve wear resistance of the steels by increasing carbides and strengthening the matrix of the steel structure. And the increase in Co is known to be advantageous for the improvement of heat resistance of the steel. As far as the wear resistance is concerned, the hardest carbide MC is effective to improve wear resistance of the steel. In this regard, V content is known to closely relate to wear resistance as V is alloying element which forms carbides of this type. However, within the practical high speed steels, even the highest alloying steels includes at most 5% V. If still more V is intended to be included, workability of the steel, such as forgeability, mechanical workability or grindability, is deteriorated. In this circumstance, development of high speed steel produced by powder metallurgical process which can solve the above mentioned defects is long desired. (see 'TETSU TO HAGANE' Vol. 61 (1975) No. 11 p.2629)

SUMMARY OF THE INVENTION

The object of the present invention is to solve problems involved with conventional nitrogen containing high speed steels produced by the powder metallurgical process. It is therefore a primary object of the present invention to provide a nitrogen containing high speed steel produced by the powder metallurgical process, which has excellent continuous cutting property.

It is a secondary object of the present invention to provide a nitrogen containing high speed steel produced by the powder metallurgical process which has long service life.

In accordance with the first aspect of the present invention in which the above and other objects are attained, a nitrogen containing high speed steel produced by the powder metallurgical process, which comprises at least 0.40% N, 3.0–15% V, C in an amount satisfying the relationship of $1.0 + 0.2V\ (\%) \leqq (C + N) \leqq 1.5 + 0.2V\ (\%)$, at least one element selected from the group consisting of up to 15% Cr, up to 10% Mo, up to 20% W and up to 15% Co, with the balance iron and the inevitable impurities.

In accordance with the second aspect of the present invention, the nitrogen containing high speed steel as set forth in the first aspect is provided wherein said steel comprises C in an amount satisfying the relationship of $1.1 + 0.2V\ (\%) \leqq (C + N) \leqq 1.5 + 0.2V\ (\%)$.

In accordance with the third aspect of the present invention, the nitrogen containing high speed steel as set forth in the first and the second aspects is provided wherein said steel comprises at least one element selected from the group consisting of up to 2% Zr, up to 5% Nb, and up to 1% B.

DETAILED DESCRIPTION OF THE PREFERRED EMBODIMENTS

The nitrogen containing high speed steels produced by the powder metallurgical process according to the present invention will now be described in detail by reference to the accompanying drawings.

A typical example of a steel powder heretofore used for production of nitrogen containing high speed steels by the powder metallurgical process, is a powder of a steel corresponding to JIS SKH 10 (comprising 1.5% C, 4.0% Cr, 5.7% Co, 11.8% W, 4.5% V with the balance iron). Nitrogen was incorporated in this steel and high speed steels differing in the nitrogen content were prepared. In these high speed steels, the influence of the nitrogen content on the machinability was examined and the results shown in FIG. 1 were obtained.

Figure 1:
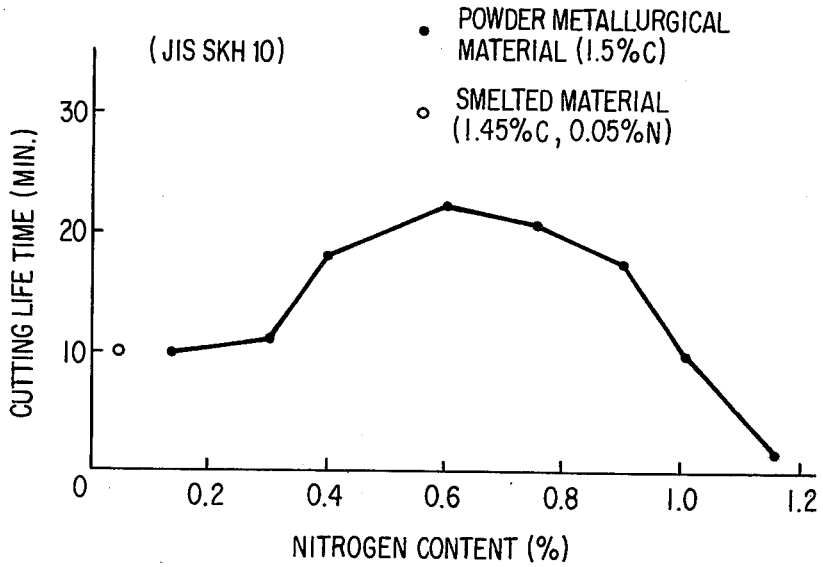
FIG. 1 is a graph illustrating the comparison of the cutting life time of the powder metallurgical steels and the steel obtained by smelting process.

As is apparent from the results shown in FIG. 1, the machinability is remarkably improved when the nitrogen content is at least 0.40% and a maximum value is obtained when the nitrogen content is approximately 0.6% and if the nitrogen content is over 0.9% the machinability is deteriorated. While in case of a nitrogen containing high speed steel containing 1.45% C and 0.05% N which is produced by smelting process, it was confirmed that the machinability is not good.

Carbon which is an essential element of high speed steels has general properties quite similar to those of nitrogen which is an additive element. Each of these elements has a very small atomic number of 6 or 7 and is an atom of the interstitial type having a tendency to readily form an alloy compound. Accordingly, it is deemed rather reasonable to adjust or regulate the nitrogen content in combination with the carbon content, for example, relying on such factors as the (C + N) content irrespective of the carbon content. Moreover, it is desired to regulate or adjust the nitrogen content after due consideration of the contents of elements which have been admitted in the art as elements capable of forming carbides or nitrides together with C and N in high speed steels, particularly vanadium.

In view of the foregoing, as illustrated in the Examples hereinafter, steel powders corresponding to JIS SKH 10 or 57, which differ in nitrogen content, were prepared and nitrogen is incorporated in these steel powders in an amount of at least 0.40% necessary for improving the machinability of the steels. Then high speed steels were prepared from these powders by the powder metallurgical process, and they were tested with respect to the machinability, and the results obtained are shown in FIGS. 2–5.

Figure 2:
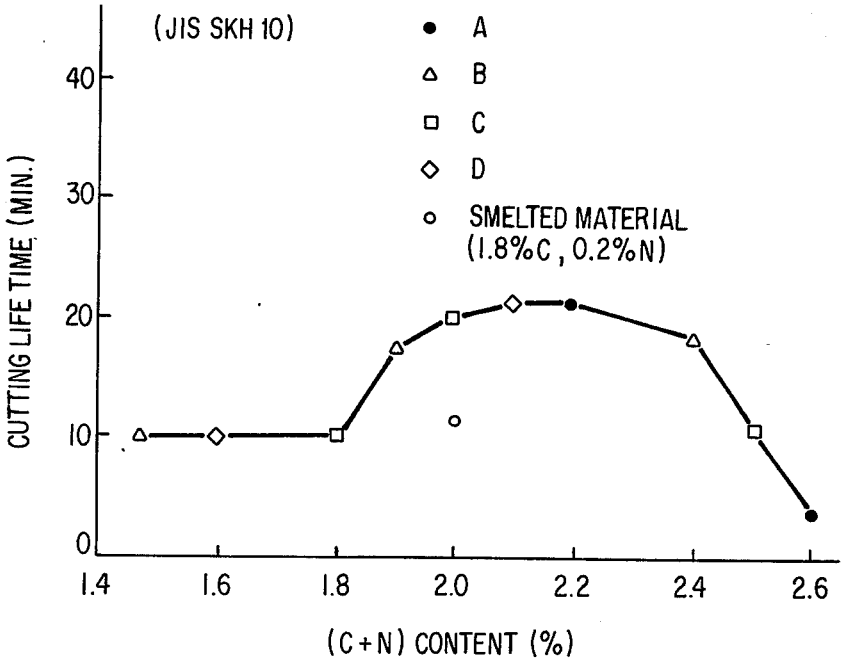
FIG. 2 is a graph illustrating the relationship of the (C + N) content of JIS SKH 10 type high speed steels versus the cutting life time.

FIG. 2 illustrates the results obtained with respect to the steels corresponding to JIS SKH 10 containing 4.45–4.53% V. It is seen from FIG. 2 that if the (C + N) content is 1.9–2.4%, the machinability is remarkably improved. Namely, in a nitrogen containing high speed steel produced by the powder metallurgical process, which corresponds to JIS SKH 10, a suitable range of the (C + N) content for improving the machinability is 1.9–2.4%.

Figure 3:
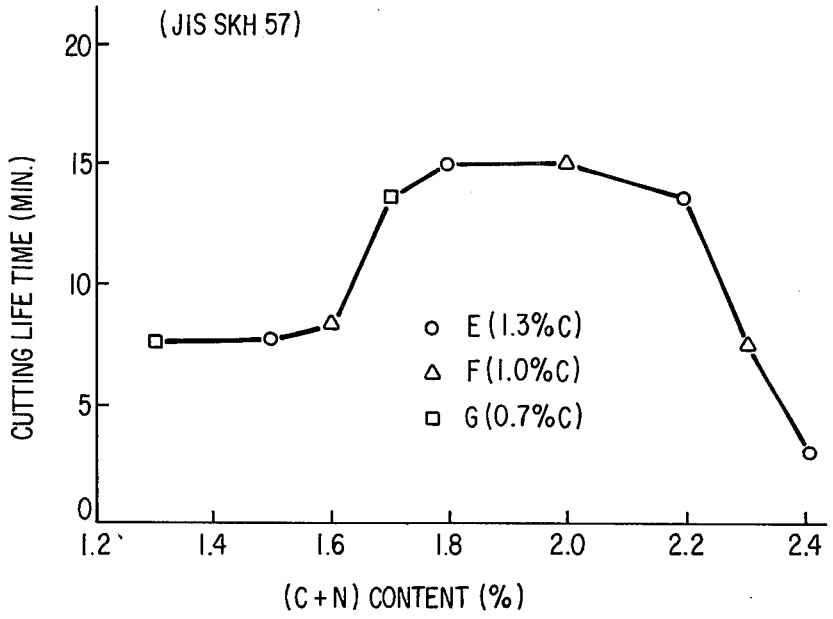
FIG. 3 is a graph illustrating the relationship of the (C + N) content of JIS SKH 57 type high speed steels versus the cutting life time.

FIG. 3 illustrates the results obtained with respect to the steels corresponding to JIS SKH 57 containing 3.52–3.53% V. From FIG. 3, it is apparent that a suitable range of (C + N) content is 1.7–2.2%.

Figure 4:
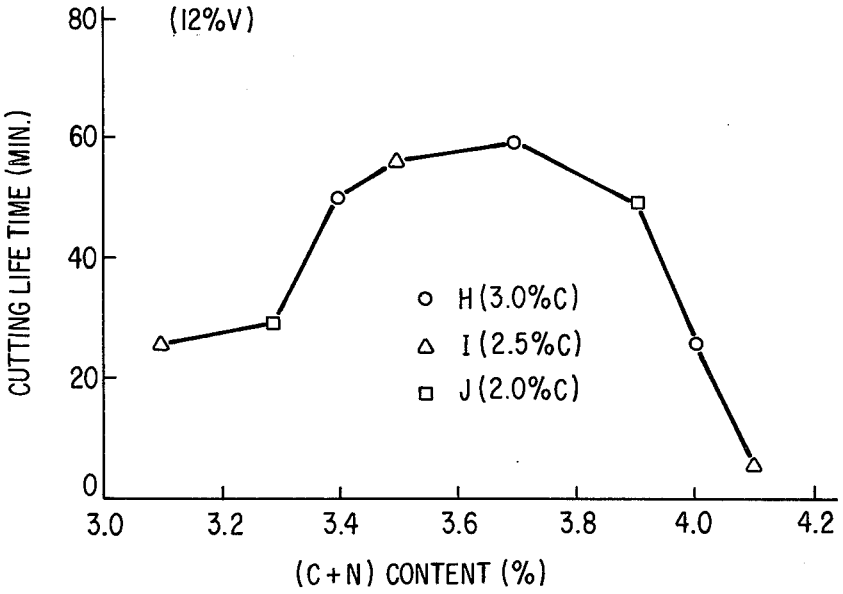
FIG. 4 is a graph illustrating the relationship of the (C + N) content of the high speed steels containing approximately 12% V versus the cutting life time.

FIG. 4 illustrates the results obtained with respect to the steels having an increased V content, namely 4% Cr-3.5% Mo-10% W-12% V steels. In this case, a suitable range of (C + N) content is 3.4–3.9%.

If the foregoing experimental results obtained with respect to various high speed steels produced by the powder metallurgical process are collectively considered mainly in view of the (C + N) and V contents, it is apparent that in order to improve the machinability of the steel, the following requirement must be satisfied:

$$1.0 + 0.2V\ (\%) \leqq (C + N) \leqq 1.5 + 0.2V\ (\%)$$

Figure 5:
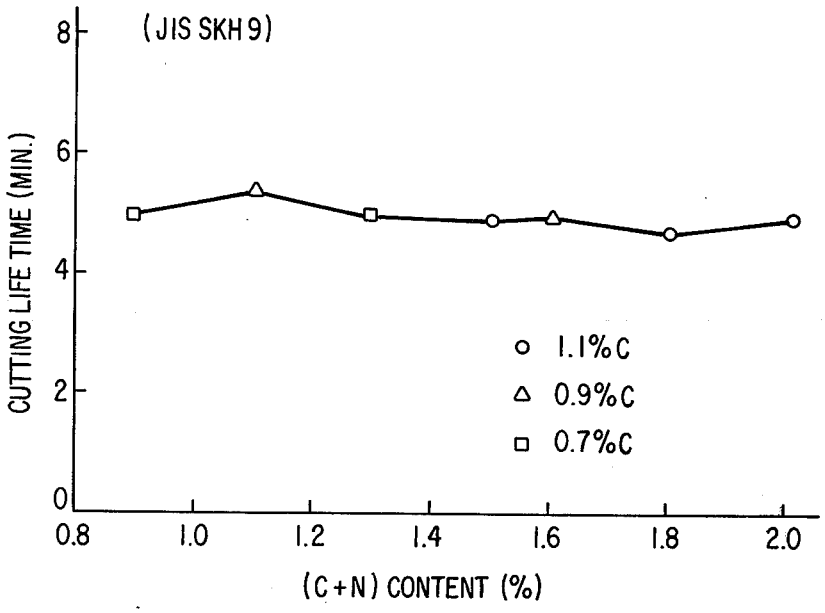
FIG. 5 is a graph illustrating the relationship of the (C + N) content of JIS SKH 9 type high speed steels versus the cutting life time.

In this requirement, if the V content exceeds 15%, the toughness ordinarily decreases drastically because a vanadium type carbonitride is coarsened, and in such case, the resulting steel has properties which make it considerably less suitable for machinability. Moreover, if the vanadium content is higher than 15%, since a vanadium type carbonitride is coarsened, the grindability and forging property are degraded very substantially. If the vanadium content is lower than 3.0%, as can be seen from FIG. 5 illustrating the machinability test results with respect to JIS SKH 9 containing 1.95–2.00% V, substantial change in the machinability could not be observed regardless of the (C +N) content. Therefore V content must be at least 3.0%. No significant improvement of the machinability is attained if the nitrogen content is lower than 0.40%. In the present invention, it is preferred that the nitrogen content be at least 0.45%.

As is apparent from the foregoing experimental results, the above mentioned relationship, namely an appropriate range of the (C + N) content, is not changed in various high speed steels differing in the content of such metals as Cr, Mo, W and Co. In general, in high speed steels, Cr is added in an amount of up to 15%, Mo is added in an amount of up to 10%, W is added in an amount of up to 20% and Co is added in an amount of up to 15%. Further, according to need, up to 2% Zr, up to 5% Nb and up to 1% B may be added.

The function of the additive elements will now be described. W is an element important for imparting the required properties to high speed steels. It combines with C, N and Fe to form a nitride of the $M_6X$ type and is dissolved in the matrix to improve the temper hardening property and the high temperature hardness and thereby enhance the wear resistance. Therefore, W makes a great contribution to the improvement of the machinability of the steel. However, if the W content exceeds 20%, no substantial increase of such effects is attained. Therefore, in the present invention, W is incorporated in an amount of up to 20%. In high speed steels, Mo exerts similar effects to those of W, but Mo is different from W from the point that it inhibits the growth of the crystal grain and it does not greatly reduce the toughness. If the Mo content exceeds 10%, however, these effects are not substantially heightened but the hot workability is degraded. Accordingly, Mo is incorporated in an amount of up to 10%. Cr is present in the matrix as carbonitrides and improves the quenching property and enhances the temper hardening property and high temperature hardness. However, if the Cr content exceeds 15%, the retained austenite content is drastically increased. Accordingly, Cr is incorporated in an amount of up to 15%. When Co is used in combination with W, Mo, V and the like, it efficiently improves the high temperature hardness, and it is an additive element important for a tool steel for hard cutting materials. However, if the Co content exceeds 15%, the quenching property and hot workability are degraded. Accordingly, Co is incorporated in an amount of up to 15%. Among impurities, Al is not preferred. The reason is that Al is present in the form of AlN which reduces the effects of N. Accordingly, it is necessary to suppress the Al content below 0.4%.

The present invention will now be described by reference to the following Examples.

EXAMPLE I

Gas-atomized steel powders corresponding to JIS SKH 10 and differing in carbon content were packed in mild steel cans, subjected to degasification and nitriding treatments and then compression-formed by a hot isostatic press heat treatment. The preparation conditions and the tests for determining the machinability are illustrated below. For comparison, a steel product prepared by subjecting a steel produced by the smelting process to a heat treatment was similarly tested, and the result obtained is described below.

(1) Preparation conditions (a) Chemical Composition and Grain Size of Starting Powder:

The starting powders used are shown in Table 1.

(b) Nitriding Treatment:

The nitriding treatment was conducted at 1150° C. for 2 hours in a nitrogen atmosphere. The pressure of the atmosphere was appropriately controlled to adjust the nitrogen content in the product steel.

(c) Hot Isostatic Press Treatment:

Hardening: 1200° C. × 3 minutes (Oil Quenching)

Table 1

| Kind of Steel | Composition (%) | | | | | | | | | | | Grain Size |
|---|---|---|---|---|---|---|---|---|---|---|---|---|
| | C | Si | Mn | P | S | Cr | W | V | Co | O | N | |
| A (1.8% C) | 1.79 | 0.18 | 0.27 | 0.01 | 0.02 | 4.02 | 12.1 | 4.48 | 4.81 | 0.028 | 0.038 | smaller than 28 mesh |
| B (1.5% C) | 1.52 | 0.15 | 0.29 | 0.02 | 0.03 | 3.98 | 11.8 | 4.51 | 4.71 | 0.031 | 0.040 | " |
| C (1.2% C) | 1.20 | 0.21 | 0.31 | 0.01 | 0.02 | 4.05 | 11.9 | 4.45 | 4.61 | 0.030 | 0.050 | " |
| D (0.9% C) | 0.91 | 0.25 | 0.25 | 0.02 | 0.03 | 3.91 | 12.3 | 4.53 | 4.85 | 0.035 | 0.031 | " |

Tempering: repeated 2–4 times with heating pattern of 560° C. × 1.5 hours. In case of comparative steel produced by the smelting process, the oil quenching was conducted at 1200° C. for 3 minutes and the tempering was repeated 2 times with a heating pattern of 560° C. × 1.5 hours.

(2) Test Conditions (a) Machinability Test:

Cutting speed: 30 m/min.
Cut depth: 1.5 mm
Feed rate: 0.2 mm/revolution
Cutting oil: not used
Tool shape: 0°, 15°, 6°, 6°, 15°, 15°, 1.0
Material machined: JIS SCM 4 (Quenched and Tempered) $H_b$ 300–350

(3) Results of Test

Test results are shown in FIG. 2. As is apparent from the results shown in FIG. 2, in nitrogen containing high speed steels containing approximately 4.5% vanadium, produced by the powder metallurgical process, in order to improve the machinability, the nitrogen content must be at least 0.40%, and an appropriate (C + N) content is in the range of 1.9–2.4%. Even in case that the (C + N) content is 1.9–2.4%, if the nitrogen content is 0.2%, no significant improvement of the machinability was observed.

EXAMPLE II

Atomized steel powders corresponding to JIS SKH 57 and differing in carbon content as shown in Table 2 were used as the starting powders and prepared into nitrogen containing high speed steels by the powder metallurgical process in the same manner as described in Example I. The machinability was tested and the results obtained are shown in FIG. 3.

As is apparent from the results in FIG. 3, a (C + N) content effective for improving the machinability is in the range of 1.7–2.2%.

EXAMPLE III

Gas-atomized steel powders containing approximately 12% vanadium and differing in carbon content as shown in Table 3 were used as the starting powders and prepared into nitrogen containing high speed steels by the powder metallurgical process in the same manner as described in Example I. The machinability was tested and the results obtained are shown in FIG. 4.

As is apparent from FIG. 4, a suitable (C + N) content effective for improving the machinability is in the range of 3.4–3.9%.

In accordance with the results obtained by the above Examples I–III wherein the cutting speed is 30m/min., the content of C, N, and V must satisfy the following requirements:

$N \geqq 0.40\%$ (preferably $N \geqq 0.45\%$)
$3.0\% \leqq V \leqq 15\%$, and $1.0 + 0.2V(\%) \leqq (C + N) \leqq L.5 + 0.2V(\%)$ thereby the excellent machinability, in particular excellent cutting life time is obtained.

Further examples will now be described wherein the cutting speed is 40 m/min.

As is readily apparent from the foregoing illustration, in the nitrogen containing high speed steel produced by the powder metallurgical process, according to the present invention, excellent machinability, in particular excellent cutting life time can be obtained by adjusting and controlling the content of C, N and V so that the following requirements are satisfied:

$N \geqq 0.40\%$, more preferably $N \geqq 0.45\%$
$3.0\% \leqq V \leqq 15\%$ and
$1.0 + 0.2V(\%) \leqq (C + N) \leqq 1.5 + 0.2V(\%)$, more preferably
$1.1 + 0.2V(\%) \leqq (C + N) \leqq 1.5 + 0.2V(\%)$. Further, said steel comprises at least one element selected from the group consisting of up to 15% Cr, up to 10% Mo, up to 20% W and up to 15% Co, with the balance iron and impurities. In addition, according to need, said steel may contain up to 2% Zr, up to 5% Nb, and up to 1% B.

Table 2

| Kind of Steel | Composition (%) | | | | | | | | | | | | Grain Size |
|---|---|---|---|---|---|---|---|---|---|---|---|---|---|
| | C | Si | Mn | P | S | Cr | Mo | W | V | Co | O | N | |
| E (1.3% C) | 1.32 | 0.16 | 0.21 | 0.01 | 0.02 | 4.05 | 3.61 | 10.5 | 3.52 | 10.2 | 0.030 | 0.030 | smaller than 28 mesh |
| F (1.0% C) | 1.03 | 0.20 | 0.28 | 0.02 | 0.02 | 4.08 | 3.56 | 9.8 | 3.50 | 10.6 | 0.028 | 0.025 | " |
| G (0.7% C) | 0.71 | 0.18 | 0.30 | 0.01 | 0.02 | 3.95 | 3.55 | 10.3 | 3.53 | 9.9 | 0.035 | 0.023 | " |

Table 3

| Kind of Steel | Composition (%) | | | | | | | | | | | Grain Size |
|---|---|---|---|---|---|---|---|---|---|---|---|---|
| | C | Si | Mn | P | S | Cr | Mo | W | V | O | N | |
| H (3.0% C) | 2.98 | 0.15 | 0.28 | 0.01 | 0.02 | 4.05 | 3.59 | 10.4 | 12.0 | 0.038 | 0.15 | smaller than 30 mesh |
| I (2.5% C) | 2.50 | 0.29 | 0.31 | 0.01 | 0.02 | 4.01 | 3.56 | 10.3 | 12.2 | 0.041 | 0.16 | " |
| J (2.0% C) | 2.01 | 0.29 | 0.30 | 0.01 | 0.02 | 4.04 | 3.61 | 9.8 | 12.3 | 0.036 | 0.18 | " |

EXAMPLE IV

Gas-atomized steel powders corresponding to JIS SKH 10 shown in Table 1 were used as the starting powders and prepared into nitrogen containing high speed steels by the powder metallurgical process in the same manner as described in Example I. The machinability was tested at the higher cutting speed and the results obtained are shown in FIG. 6.

Figure 6:
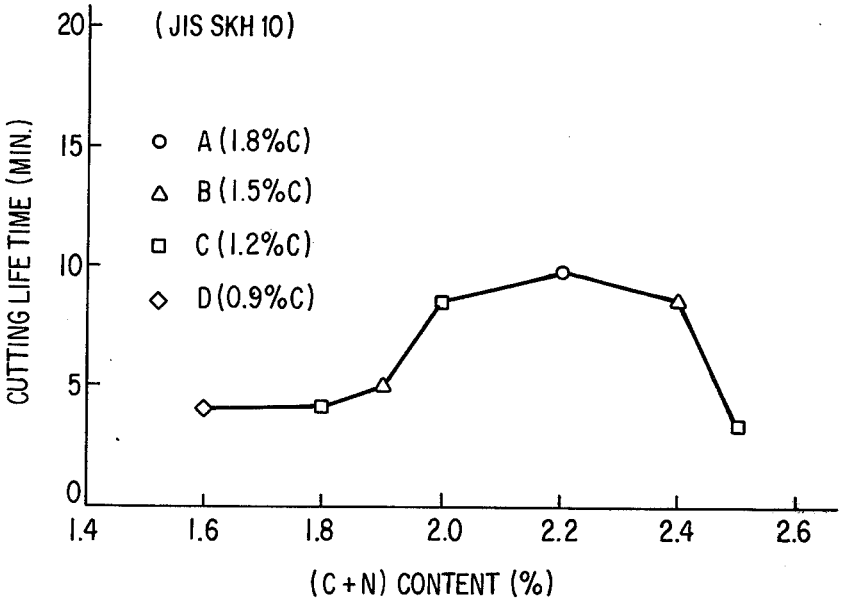
FIG. 6 is a graph illustrating the relationship of the (C + N) content of JIS SKH 10 type high speed steels versus the cutting life time.

As is apparent from FIG. 6, a suitable (C + N) content effective for improving the machinability is in the range of 1.9–2.4% more preferably, 2.0–2.4%.

EXAMPLE V

Gas-atomized steel powders corresponding to JIS SKH 57 shown in Table 2 were used as the starting powders and prepared into nitrogen containing high speed steels by the powder metallurgical process in the same manner as described in Example I. The machinability was tested at the higher cutting speed and the results obtained are shown in FIG. 7.

Figure 7:
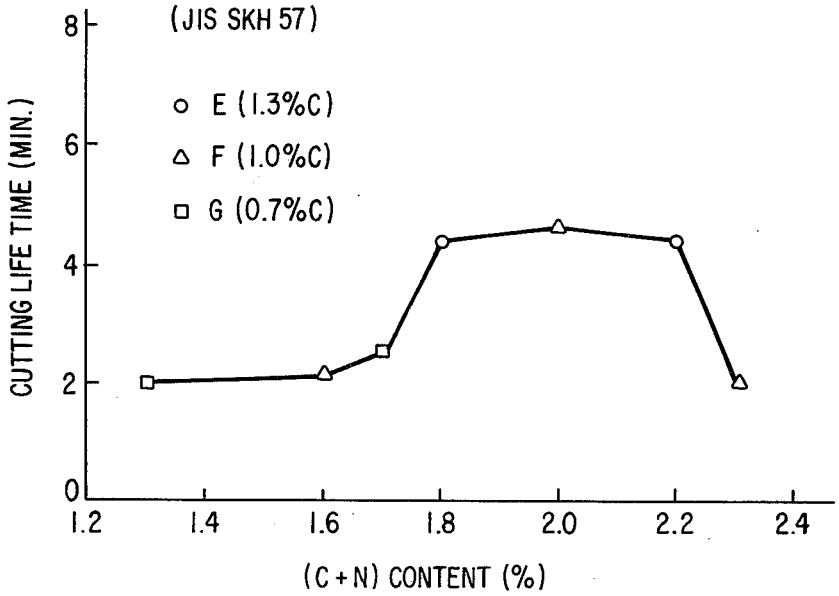
FIG. 7 is a graph illustrating the relationship of the (C + N) content of JIS SKH 57 type high speed steels versus the cutting life time.

As is apparent from FIG. 7, a suitable (C + N) content effective for improving the machinability is 1.7–2.2%, more preferably, 1.8–2.2%.

EXAMPLE VI

Gas-atomized steel powders containing approximately 12% vanadium shown in Table 3 were used as the starting powders and prepared into nitrogen containing high speed steels by the powder metallurgical process in the same manner as described in Example I. The machinability was tested at the higher cutting speed and the results obtained are shown in FIG. 8.

Figure 8:
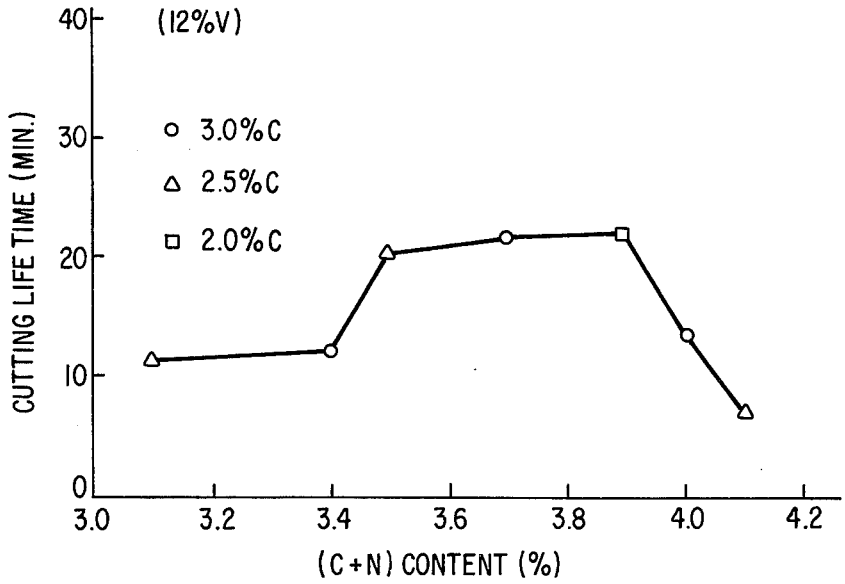
FIG. 8 is a graph illustrating the relationship of the (C + N) content of the nitrogen containing high speed steel containing approximately 12% V versus the cutting life time when the cutting speed is high.

As is apparent from FIG. 8, a suitable (C + N) content effective for improving the machinability is 3.4–4.0%, more preferably, 3.5–3.9%.

What is claimed as new and intended to be secured by Letters Pat. is:

1. A nitrogen containing high speed steel produced by the powder metallurgical process from a prealloyed powder which is then nitrided and hot isostatically pressed, wherein said high speed steel comprises: at least 0.40% N, 3.0–15% V, C in an amount satisfying the relationship of $1.0 + 0.2V(\%) \leq (C + N) \leq 1.5 + 0.2V(\%)$, at least one element selected from the group consisting of up to 15% Cr, up to 10% Mo, up to 20% W and up to 15% Co and the balance iron.

2. The nitrogen containing high speed steel as set forth in claim 1, wherein C content is in an amount satisfying the relationship of $1.1 + 0.2V(\%) \leqq (C + N) \leqq 1.5 + 0.2V(\%)$.

3. The nitrogen containing high speed steel as set forth in claim 1, wherein N content is at least 0.45%.

4. The nitrogen containing high speed steel as set forth in claim 1, which further comprises: at least one element selected from the group consisting of up to 2% Zr, up to 5% Nb and up to 1% B.

5. The nitrogen containing high speed steel as set forth in claim 1 wherein (C + N) is 1.7–2.2%.

6. The nitrogen containing high speed steel as set forth in claim 1 wherein (C + N) is 3.4–3.9%.

7. The nitrogen containing high speed steel as set forth in claim 1 wherein the nitrogen content is 0.40%–0.90%.

* * * * *

UNITED STATES PATENT AND TRADEMARK OFFICE

CERTIFICATE OF CORRECTION

PATENT NO. : 4,121,929

DATED : October 24, 1978

INVENTOR(S) : Nobuyasu Kawai et al

It is certified that error appears in the above-identified patent and that said Letters Patent are hereby corrected as shown below:

Column 2, line 15, delete "0.5-0.5%", and insert -- 0.4-0.5% --.

Column 2, line 45, delete "Vol. 61", and insert --Vol. 65--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*